United States Patent [19]

Dennis

[11] 4,071,883

[45] Jan. 31, 1978

[54] MULTI-PURPOSE LABORATORY LIGHT BOX

[76] Inventor: Juanita Dennis, 1225 Derby St., Berkeley, Calif. 94702

[21] Appl. No.: 727,358

[22] Filed: Sept. 28, 1976

[51] Int. Cl.[2] ..... G09F 13/04

[52] U.S. Cl. ..... 362/97; 40/361; 355/113; 40/574

[58] Field of Search ..... 240/2 AT, 2 D, 2 P; 355/113, 119, 121; 40/106.1

[56] References Cited

U.S. PATENT DOCUMENTS

| | | | |
|---|---|---|---|
| 1,988,654 | 1/1935 | Haag | 40/106.1 |
| 2,479,008 | 8/1949 | Highfield et al. | 240/2 D |
| 2,567,561 | 9/1951 | Hoffmann | 40/106.1 |
| 3,112,887 | 12/1963 | Brou et al. | 240/2 AT |
| 3,136,232 | 6/1964 | Shoberg et al. | 355/113 |

*Primary Examiner*—R. N. Envall, Jr.

[57] ABSTRACT

A multi-purpose laboratory light box for observation and photographic procedures comprises a box of convenient size having two slidable top panels adapted to be moved toward and away from each other to provide an opening of variable width and location. The box is covered with light-absorbing black material inside and out. A pair of tubular fluorescent lamps are mounted respectively within the box on the facing edge portions of the two top panels, the lamps being adjacent the panels and substantially flush with the facing edges of the panels. In use, the lamps are energized to provide light in the variable opening between the top panels for purposes of observing and photographing desired characteristics of various laboratory specimens. Fluorescent lamps of different characteristics such as white light and ultraviolet light are useable interchangeably, depending on requirements. An invertible panel member covered with black velvet material on one face and white reflecting material on the other face may be used on the interior box bottom to provide light absorption or light reflection, depending on the requirements for a particular observation or photographic procedure. Plate members of various light-transmitting materials are provided to rest on the top panels and overlie the illuminated opening between the panels.

8 Claims, 3 Drawing Figures

MULTI-PURPOSE LABORATORY LIGHT BOX

BACKGROUND OF THE INVENTION

This invention relates to a laboratory light box, and more particularly to a multi-purpose light box suitable for a variety of observation and photographic procedures.

The light box of the invention fulfills lighting needs for observation and photography of a wide variety of tests performed in virological, microbiological and clinical laboratories using either white or ultraviolet light. By way of example, unstained immunoprecipitates in gel double diffusion, radial immunodiffusion and immunoelectrophoresis tests are examined and photographed using dark ground illumination, as is observation of bacterial growth in the bacterial inhibition assay for blood phenylalanine.

Observation and photography of stained immunoprecipitates and of stained protein bands in polyacrylamide gels is done against a white background. A white background is also used for viewing and photographing plaques produced by viruses, and for reading complement fixation, hemagglutination-inhibition and metabolic-inhibition tests in microtiter plates.

The light box also serves as a highly satisfactory source of illumination when using a dissecting microscope for counting very small viral plaques or foci of hemadsorbing cells, for reading tests in test tubes, for various photographic procedures such as slide duplicating, title layout and negative retouching, and for tracing.

Various lighting devices for laboratory observation and photography are available for specific purposes, but none has the versatility of the present light box which is suitable for numerous observation and photographic procedures. U.S. Pat. No. 3,802,102, for example, discloses a light box of limited versatility.

SUMMARY OF THE INVENTION

The invention contemplates a multi-purpose laboratory light box comprising a box having bottom, side and end panels secured to each other in light-tight manner, guide means on the end panels in spaced relation with the bottom panel, a pair of top panels disposed in the guide means and adapted to be moved manually toward and away from each other to provide an opening of variable width and location, a pair of tubular fluorescent lamps respectively mounted within said box on the facing edge portions of the top panels, the lamps being adjacent the panels and substantially flush with the facing edges of the panels, and circuit means for energizing the lamps for observation and photography.

The interior and exterior of the side, end and top panels are covered with light-absorbing black material, and the interior of the bottom panel alternatively is covered with light-absorbing black material, such as black velvet or black paint, and white reflecting material, depending on the requirements of a particular procedure.

In more detailed aspect, the interior of the bottom panel may be provided with an invertible or "flip" panel member covered with black velvet material on one face (for dark ground illumination) and white reflecting material on the other face (for diffuse transmitted light against a white background), the panel member being positioned with one or the other material on the upper face, depending on the observation or photographic requirements.

The top panels preferably are of like size with the outer edge portions extending beyond the side walls when the top panels are in positions abutting each other so the outer edge portions may be grasped manually to move the top panels to provide an illuminated opening of desired size and location for a variety of observation and photographic procedures.

Reflecting members preferably are mounted adjacent the lamps on the sides thereof away from the facing edges of the top panels, the members adapted to reflect toward each other so as to maximize the light available at the opening between the two panels.

Fluorescent lamps of different characteristics are useable in the light box to extend the utility of the box. For example, white light fluorescent lamps and ultraviolet light fluorescent lamps are provided for interchangeable use.

Plate members of various materials are provided to rest on the top panels and overlie the illuminated opening between the panels. For example, a plate member of flashed opal glass provides maximum diffusion of light for observation and photography. Other plate members of clear glass or plastic material and of photographic filter materials also are provided.

Other objects, advantages and features of the invention will be apparent as the description proceeds, reference being had to the accompanying drawing wherein one form of the invention is shown. It is to be understood that the description and drawing are illustrative only, and that the scope of the invention is to be measured by the appended claims

DESCRIPTION OF THE ILLUSTRATED EMBODIMENT

Figure 1:
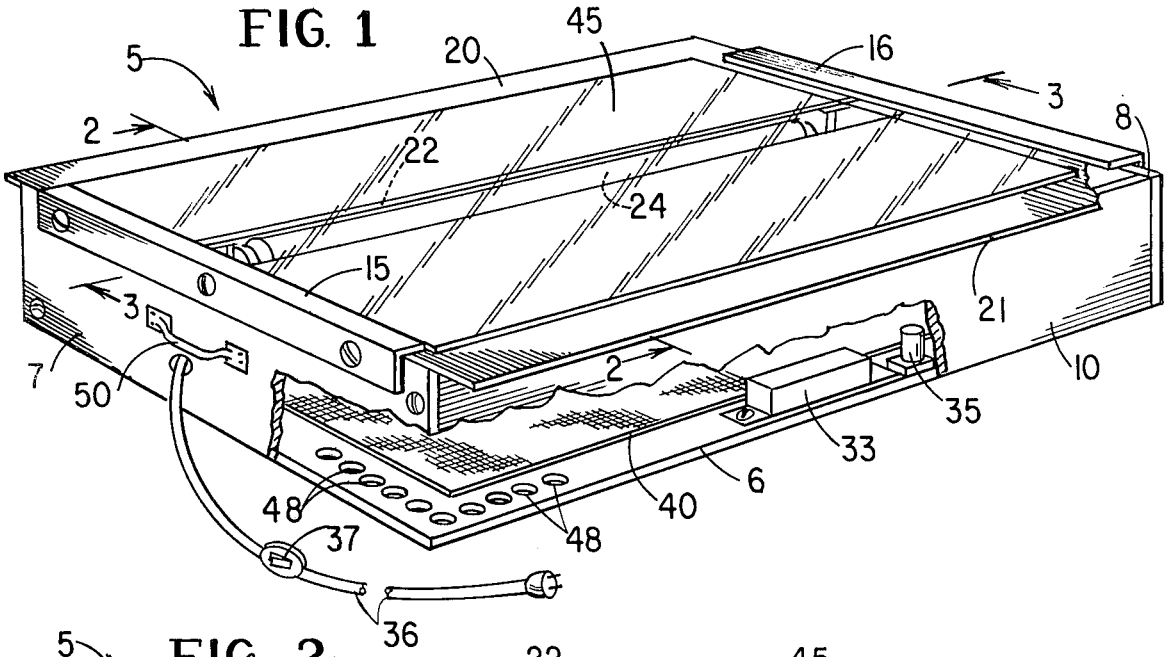
FIG. 1 is a perspective view, partly broken away, of a multi-purpose laboratory light box embodying the invention.

Referring to the drawing, a multi-purpose laboratory light box embodying the invention is generally designated 5 in all the FIGS.

Light box 5 has a bottom panel 6, end panels 7 and 8, and side panels 9 and 10. The side and end panels and the bottom panel are secured to each other in light-tight manner.

Guide means 15 and 16 are associated with end panels 7 and 8 in spaced relation with bottom panel 6. As shown, guide means 15 and 16 are simple angle members secured to the end panels to provide guide channels between the upper edges of the end panels and the overlying legs of the angle members.

Light box 5 also includes a pair of top panels 20 and 21, the top panels disposed in guide means 15 and 16 and adapted to be moved toward and away from each other to provide an opening 22 in the box of variable width and location.

Top panels 20 and 21 preferably are of like size with outer edge portions extending beyond side walls 9 and 10 when the top panels are in positions abutting each other, whereby the outer edge portions may be grasped manually to move the top panels to vary the size and location of the opening 22 between the facing edges of the panels.

Figure 2:
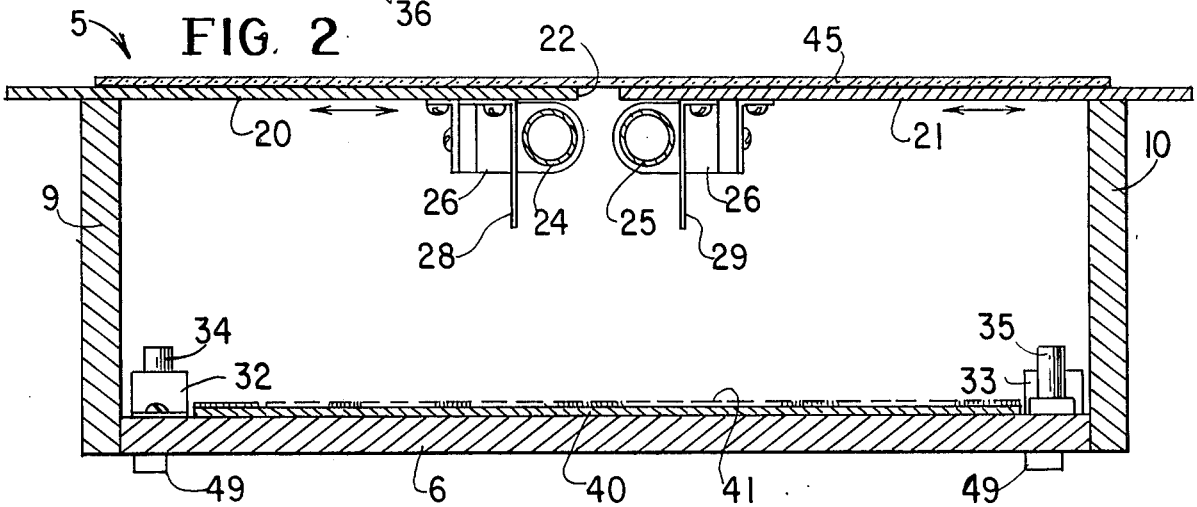
FIG. 2 is a sectional view on line 2—2 of FIG. 1.
Figure 3:
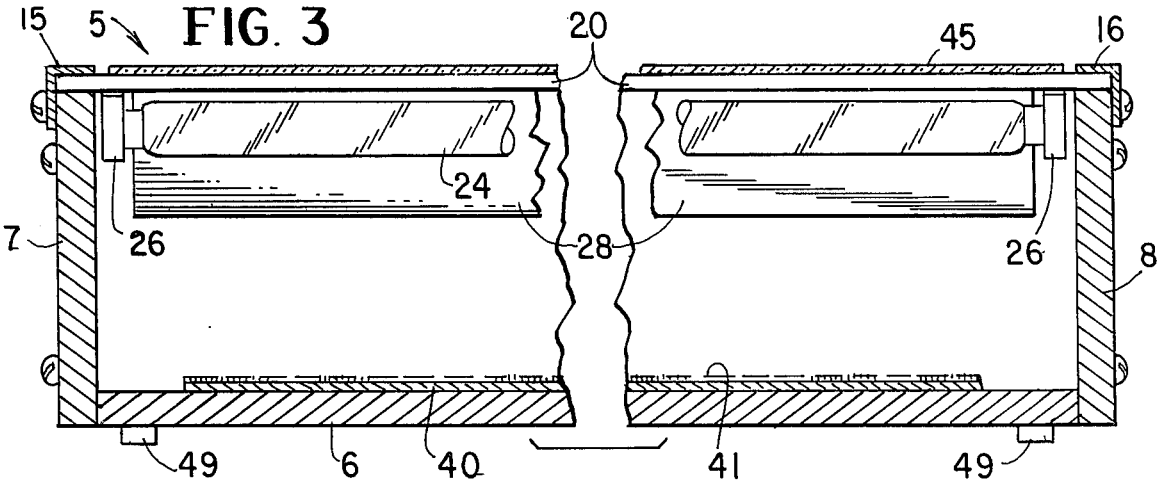
FIG. 3 is a sectional view on line 3—3 of FIG. 1.

Tubular fluorescent lamps 24 and 25 respectively are mounted within box 5 on the facing edge portions of the top panels 20 and 21, the lamps 24 and 25 being adjacent the underfaces of the panels and substantially flush with the facing edges of the panels, as best shown in FIG. 2. It has been found important from the standpoint of optimum illumination in opening 22 to mount the lamps as close as possible to the underface of top panels 20 and 21 and substantially flush with the panel edges.

Suitable lamp sockets 26 secured to top panels 20 and 21 are provided at each end of lamps 24 and 25, the sockets permitting easy removal and replacement of lamps when the top panels are moved outwardly to provide an access opening.

In the form of the invention shown, light reflecting members 28 and 29 respectively are mounted adjacent lamps 24 and 25 on the sides of the lamps away from the facing edges of the top panels, the reflecting members adapted to reflect toward each other.

Conventional circuit means for energizing lamps 24 and 25 are provided, including ballasts 32 and 33, starters 34 and 35, power cord 36 (FIG.1), power switch 37 on cord 36 and circuit connections (not shown) within box 5.

The interior and exterior of the side, end and top panels and the interior of the bottom panel are covered with light-absorbing black material such as photographic black paint.

In some forms of the invention the interior of the bottom panel is covered with deep pile black velvet. Such material has been found superior to photographic black paint for the interior of the bottom panel.

A removal panel (not shown) having a reflecting white surface is provided to cover the above-mentioned black velvet on interior of the bottom panel when reflected light is desired for observation or photography.

In the illustrated form of the invention an invertible or "flip" panel member 40 is provided for covering the interior surface of bottom panel 6. One face of panel 40 is covered with black velvet material 41, and the other face is covered with reflecting material such as white paint, for example. Panel member 40 is disposed on bottom panel 6 with the black velvet material or the reflecting material facing up, depending on procedural requirements.

Plate members of various materials, exemplified by plate member 45 in the drawing, are provided to rest on movable top panels 20 and 21 and overlie the illuminated opening 22 between the panels. By way of example, a plate member of flashed opal glass provides maximum diffusion of light for certain observations and photography, while a plate member of clear glass or plastic material is inside for other observations. Other plate members of photographic filter materials are provided, as well as a slide-duplicating plate member with filter holders for copying of transparencies in either color or black and white.

As shown in FIG. 1, bottom panel 6 is provided with a plurality of appertures 48 for venting heat from the interior of box 5. Appertures 48 are shown only in the visible corner of bottom panel 6, but it is understood that similar appertures may be provided in other corners or elsewhere. Invertible panel member 40 which rests on bottom panel 6 is of such size as to avoid interference with appertures 48 and as to permit removal and inverted replacement when top panels 20 and 21 are moved to maximize the size of opening 22.

Feet 49 on bottom panel 6 serve to space the panel from a supporting surface so the heat venting appertures 48 will be effective.

For ready portability, a handle 50 is secured to end panel 7, as shown in FIG. 1.

In one commercial embodiment of the invention, light box 5 is about 21 inches long, 14 inches wide and $4\frac{1}{2}$ inches deep.

One type of white light fluorescent lamp used in the light box of the aforesaid size is the F15-T8 (GE Chroma 50). This lamp is useful for photography as well as for reading tests in immunodiffusion plates, microtiter plates, etc. Another type of fluorescent lamp suitale for use in the light box for different observation and photographic purposes is the self-filtering black-light blue lamp (BLB-GE) which emits long wave ultraviolet light.

From the above description, it is thought that the construction and advantages of this invention will be readily apparent to those skilled in the art. Various changes in detail may be made without departing from the spirit or losing the advantages of the invention.

Having thus described the invention, what is claimed as new and desired to secure by Letters Patent is:

1. A multi-purpose laboratory light box, comprising:
- a box having a bottom panel and side and end panels secured to each other in light-tight manner;
- guide means on said end panels in spaced relation with said bottom panel;
- a pair of top panels disposed in said guide means and adapted to be moved toward and away from each other to provide an opening therebetween of variable width and location;
- a pair of tubular fluorescent lamps respectively mounted within said box on the facing edge portions of said top panels, said lamps being adjacent to and substantially flush with the facing edges of said top panels, and
- circuit means for energizing said lamps for observation and photography.

2. The light box of claim 1 wherein the interior and exterior of said side, end and top panels and the interior of said bottom panel are covered with light absorbing black material.

3. The light box of claim 2 wherein said light-absorbing black material on the interior of said bottom panel is black velvet.

4. The light box of claim 1 wherein the interior and exterior of said side, end and top panels are covered with light-absorbing black material and the interior of said bottom panel is covered with light reflecting material.

5. The light box of claim 1 wherein the interior and exterior of said side, end and top panels are covered with light absorbing black material and the interior of said bottom panel is covered with an invertible panel member covered with black velvet material on one face and light reflecting material on the other face.

6. The light box of claim 1 wherein said top panels are of like size with outer edge portions extending beyond said said walls when said top panels are in positions abutting each other, whereby said outer edge portions may be grasped manually to move said top panels to provide an illuminated opening of desired size and location for observation and photography.

7. The light box of claim 1 with the addition of light reflecting members mounted adjacent said lamps on the sides thereof away from the facing edges of said top panels, said members adapted to reflect toward each other.

8. The light box of claim 1 with the addition of a light-transmitting plate member adapted to rest on said movable top panels and overlie the illuminated opening between said panels.

* * * * *